US005695318A

United States Patent [19]

Harmsen

[11] Patent Number: 5,695,318

[45] Date of Patent: Dec. 9, 1997

[54] DIAGONAL FAN

[75] Inventor: Siegfried Harmsen, St. Georgen, Germany

[73] Assignee: Papst-Motoren GmbH & Co KG, St. Georgen, Germany

[21] Appl. No.: 636,468

[22] Filed: Apr. 26, 1996

Related U.S. Application Data

[63] Continuation of Ser. No. 291,243, Aug. 16, 1994, abandoned, which is a continuation of Ser. No. 931,294, Aug. 17, 1992, abandoned.

[30] Foreign Application Priority Data

Aug. 15, 1991 [DE] Germany ..... 41 27 134

[51] Int. Cl.[6] ..... F04D 29/18

[52] U.S. Cl. ..... 415/218.1; 415/219.1

[58] Field of Search ..... 416/245 R; 415/218.1, 415/219.1, 220, 119

[56] References Cited

U.S. PATENT DOCUMENTS

| | | |
|---|---|---|
| 2,544,813 | 3/1951 | Wall . |
| 3,175,755 | 3/1965 | Rockafield . |
| 3,260,443 | 7/1966 | Garnett et al. . |
| 3,384,295 | 5/1968 | Hayner et al. . |
| 3,515,498 | 6/1970 | Tomita . |
| 3,584,968 | 6/1971 | Keith . |
| 3,597,117 | 8/1971 | Zoehfeld . |
| 3,700,358 | 10/1972 | Papst et al. . |
| 4,371,313 | 2/1983 | Burgbacher et al. . |
| 4,373,861 | 2/1983 | Papst et al. . |
| 4,569,631 | 2/1986 | Gary, III . |
| 4,569,632 | 2/1986 | Gary, III . |
| 4,909,711 | 3/1990 | Burgbacher et al. . |
| 5,026,251 | 6/1991 | Kinoshita et al. . |
| 5,167,489 | 12/1992 | Wadia et al. . |
| 5,184,938 | 2/1993 | Harmsen . |
| 5,217,351 | 6/1993 | Meier et al. . |
| 5,249,922 | 10/1993 | Sato et al. . |
| 5,320,493 | 6/1994 | Shih et al. . |

FOREIGN PATENT DOCUMENTS

| | | |
|---|---|---|
| 0180176 | 5/1986 | European Pat. Off. . |
| 0298861 | 1/1989 | European Pat. Off. . |
| 0717272 | 1/1932 | France . |
| 0968721 | 12/1950 | France . |
| 0893117 | 10/1953 | Germany . |
| 0810834 | 3/1957 | United Kingdom . |
| 0849744 | 9/1960 | United Kingdom . |
| 0858640 | 1/1961 | United Kingdom . |
| 1004677 | 9/1965 | United Kingdom . |
| 1085565 | 10/1967 | United Kingdom . |
| 1142732 | 2/1969 | United Kingdom . |
| 1328082 | 8/1973 | United Kingdom . |

*Primary Examiner*—John T. Kwon
*Attorney, Agent, or Firm*—Nils H. Ljungman and Associates

[57] ABSTRACT

This invention relates to a diagonal fan with a truncated cone shaped hub (4*a*) of the fan wheel (4) and a truncated cone shaped air housing (2). The angle of the truncated cone of the hub (4*a*) and of the truncated cone of the air housing (2) are relatively small, the outlet cross section (15*b*) of the flow channel (15) is slightly narrower than the inlet cross section (15*a*), and the exhaust direction (23) of the flow channel (15) retains these angles, i.e. it is not deflected by any additional deflector walls.

17 Claims, 4 Drawing Sheets

DIAGONAL FAN

Figure 1:
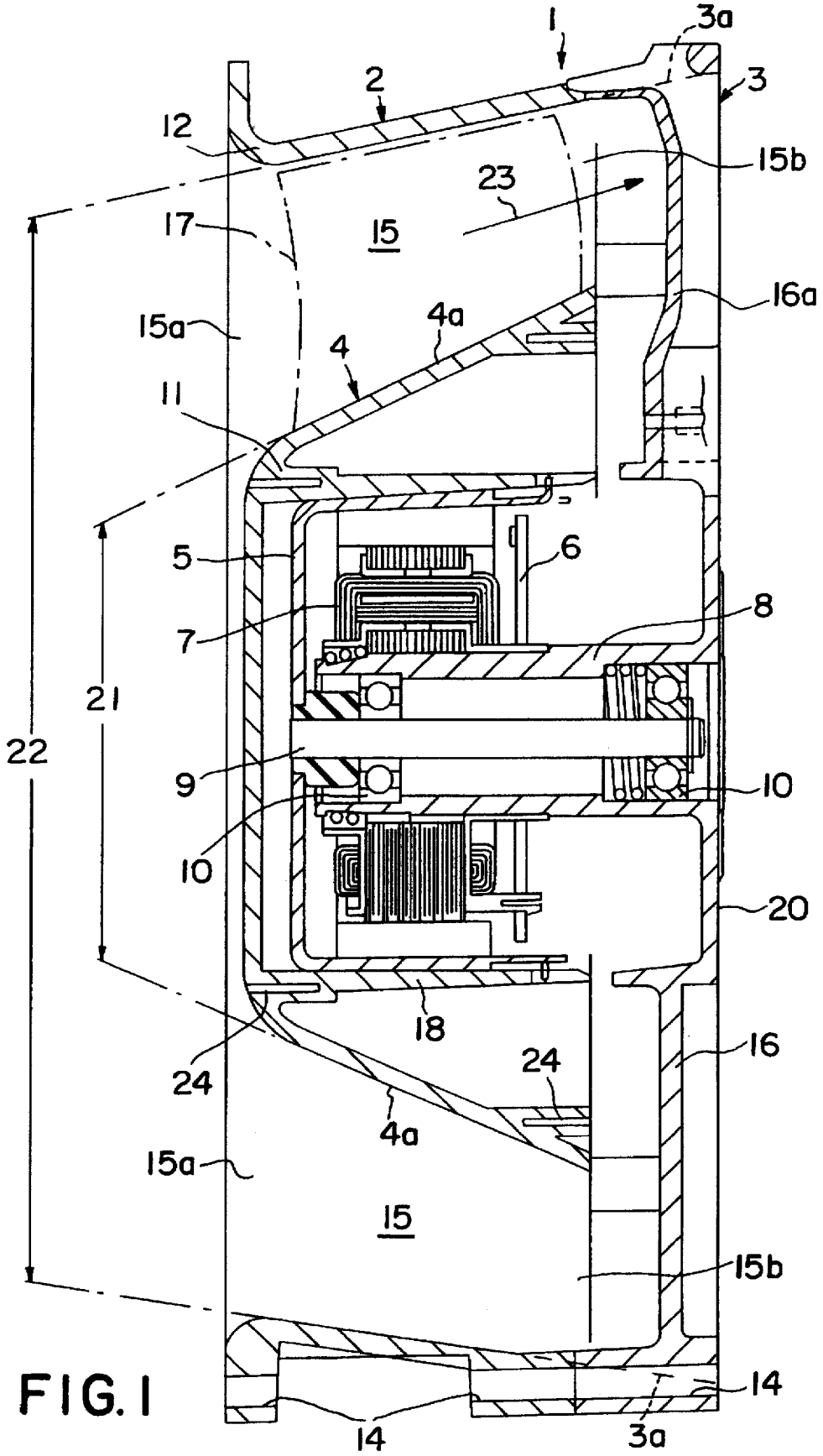

This is a continuation, of U.S. Ser. No. 08/291,243, filed on Aug. 16, 1994 abandoned, which claims continuation status from U.S. Ser. No. 07/931,294, filed on Aug. 17, 1992, now abandoned.

This invention relates to a diagonal fan with an essentially ring-shaped flow channel between the hub of an electrically driven fan wheel and an air housing surrounding the fan wheel, whereby the hub and the air housing are designed in the form of two concentric truncated cones and the fan blades move in close contact with the air housing—except for a tolerance gap.

Such diagonal fans of different variations are already known (GB 858 640, GB 13 28 082, DE-OS 29 05 624 and 31 28 654). In terms of their characteristics, diagonal fans are between axial fans (low pressure increase, high volumetric displacement) and radial fans (high pressure increase, low volumetric displacement), i.e. diagonal fans work with a medium pressure increase and a medium volumetric displacement.

Axial fans have been used successfully to cool electronic components and similar items, on account of their small size and their extremely quiet operation. But if the devices to be cooled have an excessively high flow resistance, the high volumetric displacements cannot be maintained with axial fans, since the pressure increases which can be achieved with such fans are not sufficient to overcome such increased flow resistances without increasing the power. An increase in the speed and thus in the displacement pressure is generally out of the question on account the noise generated; likewise it is generally impossible to increase the size of such fans.

The object of the present invention is to propose a diagonal fan which can be used like axial fans to cool or ventilate electronic components or similar devices, and which makes possible, with the same size and without increasing the noise, a higher displacement pressure with a sufficient displacement volume.

This object is achieved by the present invention, which is a diagonal fan of the type described above, because the angle of the truncated cone of the hub of the fan wheel is 30 degrees to 55 degrees, and the angle of the truncated cone of the air housing is 15 degrees to 30 degrees, with the proviso that the outlet cross section is slightly narrower than the inlet cross section of the flow channel, and that the exhaust direction of the flow channel is retained with the same angles, i.e. it is not deflected.

The fan according to the invention has the advantage over axial fans that the exhaust direction is changed only insignificantly as a result of the relatively small conical angle of the hub and air housing, but that, because of the use of the diagonal fan principle and the slight narrowing of the flow channel, a pressure increase is achieved while the volumetric displacement remains approximately the same. The angles of the truncated cones of the hub and of the air housing are preferably 50 degrees and 20 degrees respectively.

The following measures are preferably implemented to further reduce the noise: The drive motor of the fan with its bearings for the fan wheel is mounted on the outlet side of the flow channel by means of approximately radial webs. The fan blades are preferably sickle-shaped, whereby the leading edges are concave and the trailing edges are convex, and have approximately the same lengths in the flow direction in the various circumferential planes. The fan blades are preferably profiled, preferably with a radius on the leading edge of 1% and a profile thickness of 5% to 7% of the profile length in the flow direction. The fan blades have the same shape as one another, but they are distributed over the circumference at unequal angular intervals, preferably at the angular intervals 72 degrees, 69 degrees, 75 degrees, 67.5 degrees and 76.5 degrees for 5 blades. The inlet radii on the hub and the air housing are relatively large, namely 10 to 20 mm on the hub, preferably 15 mm, and 5 to 10 mm at the air housing, preferably 6 mm.

An additional configuration of the fan features a particularly compact design, in that the drive motor is located in the cavity of the truncated cone shaped hub of the fan wheel, and is designed in particular as a motor with an external rotor. The drive motor is preferably a brushless direct current motor with a permanent magnet external rotor, and has a relatively low speed, namely from 2000 to 3000 rpm, in particular 2400 to 2600 rpm, preferably 2500 rpm.

For reasons relating to ease of manufacture, the housing of the diagonal fan is appropriately designed in two parts, namely consisting of a truncated cone shaped air housing, preferably in the form of a one-piece injection molded plastic part, and a mounting piece to hold and mount the drive motor with the fan wheel, preferably designed as a one-piece aluminum die casting. This combination has the advantage that the air housing, which has a larger volume and an aerodynamically specific shape, can be manufactured as a relatively lightweight injection molded plastic part, while the mounting piece, which has a smaller volume, is manufactured as a stable aluminum die casting and has greater stability. Appropriately, a mounting flange and approximately radial webs to mount the drive motor are molded on the mounting piece, whereby the support flange also has a bearing tube for the mounting of the rotor and to hold the stator of the drive motor.

Figure 2:
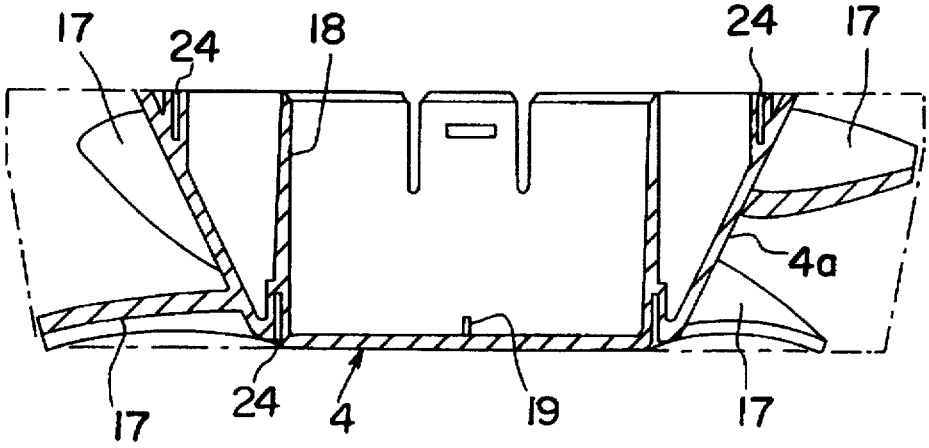
Figure 3:
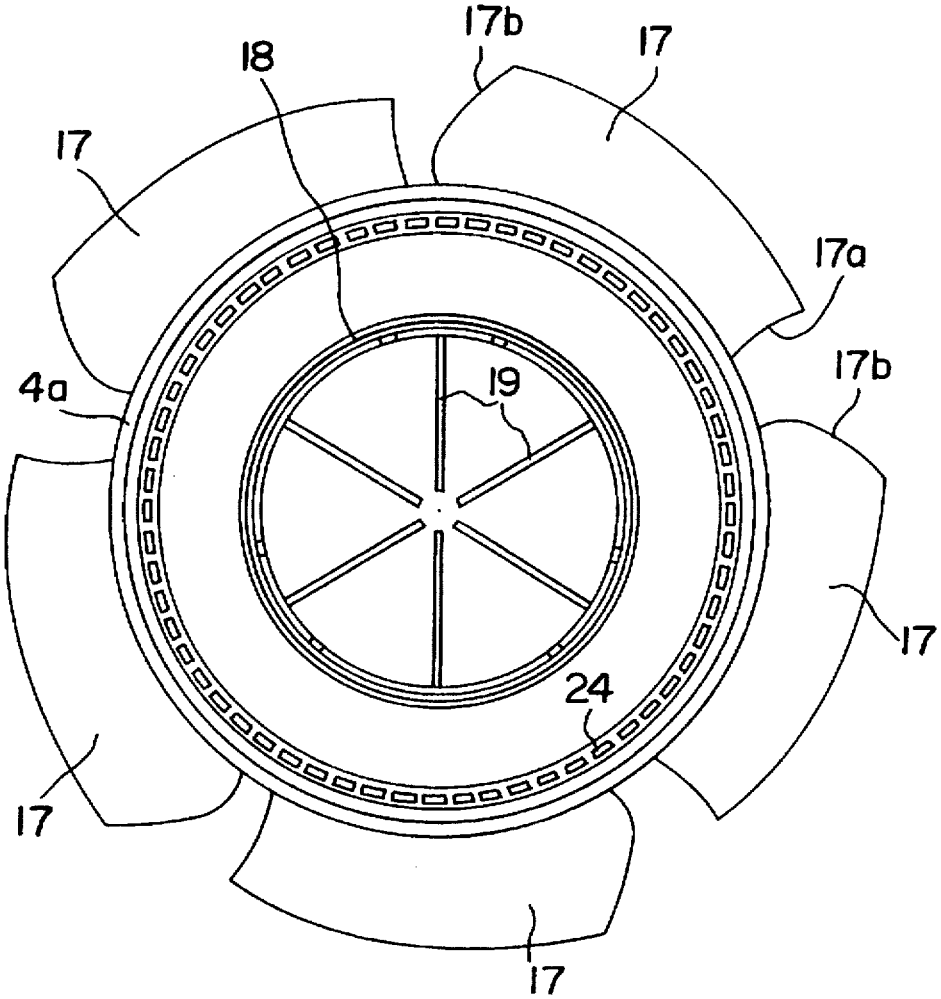
Figure 4:
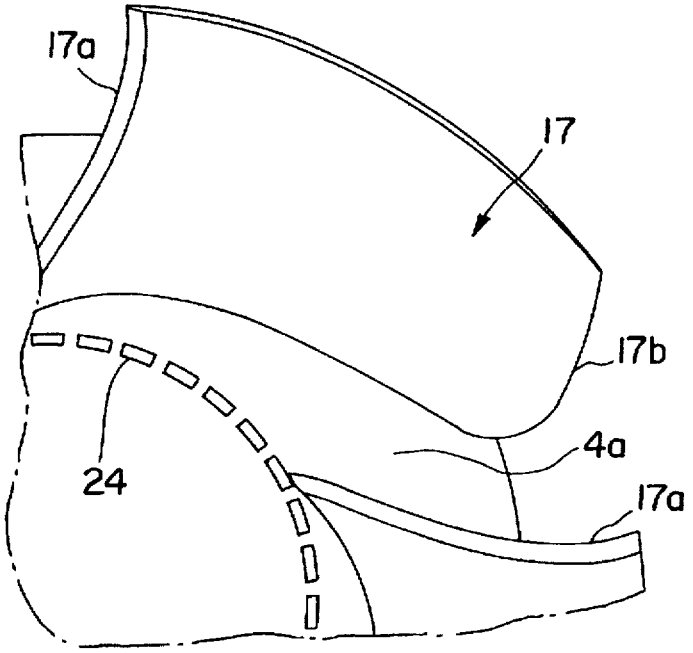
Figure 5:
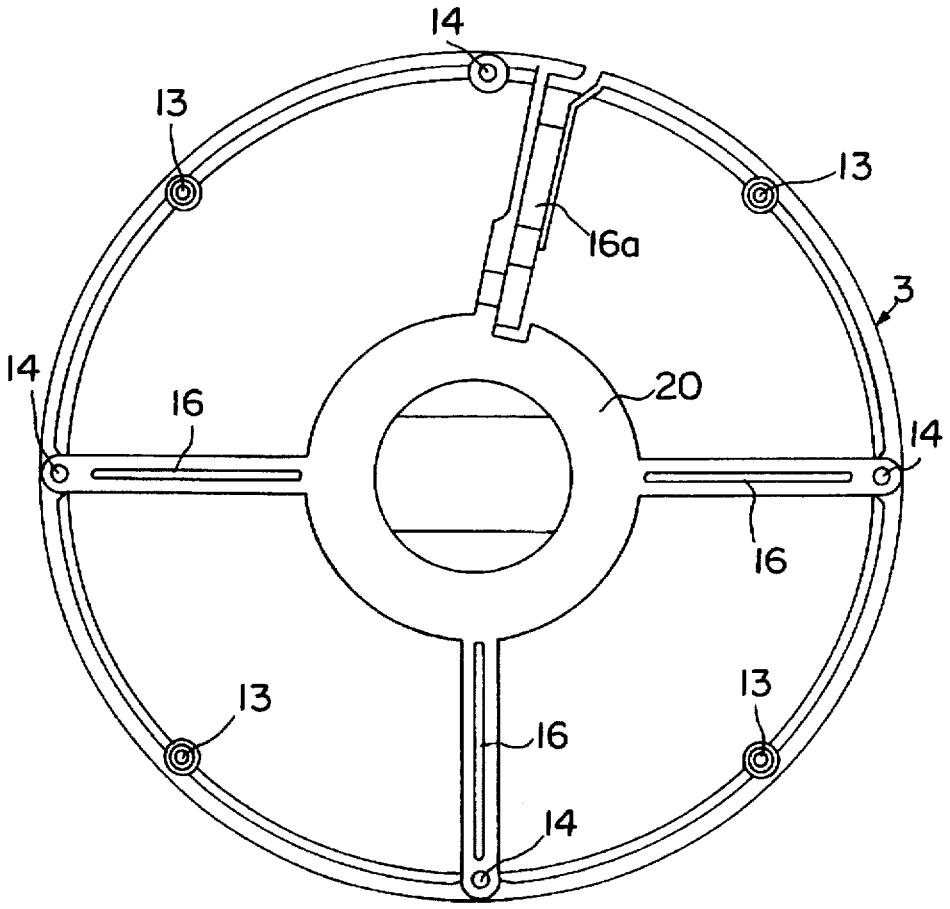

The invention is described below in greater detail, with reference to the accompanying drawings, which show:

FIG. 1: a cross section through a diagonal fan according to the present invention, whereby the fan blades are only indicated for simplification;

FIG. 2: a longitudinal section through a fan wheel of the diagonal fan illustrated in FIG. 1;

FIG. 3: an end view of the fan wheel illustrated in FIG. 2, viewed from the exhaust end;

FIG. 4: shows a detail of an end view of the fan wheel illustrated in FIG. 2, viewed from the intake side, and FIG. 5: shows an end view of a portion of the housing of the diagonal fan illustrated in FIG. 1, viewed from the exhaust end.

FIGS. 6 to 9 illustrate a second embodiment.

The housing 1 of the diagonal fan consists essentially of two parts, namely an air housing 2 and a mounting part 3, which are connected to one another by means of threaded connectors 13 (FIG. 5). Inside the air housing 2 there is a fan wheel 4, on whose hub 4*a* there are fan blades 17 projecting approximately radially. These fan blades 17 are not shown in FIG. 1, but are indicated only in the upper part of the figure by an envelope in dotted lines.

An approximately ring-shaped flow channel 15 is formed between the hub 4*a* and the inside wall of the air housing 2, whereby the intake side is on the left in FIG. 1, and the exhaust end on the right, as indicated by the direction of the arrow 23. The hub 4*a* and the air housing 2 have the shape of a truncated cone, whereby the corresponding radii increase from the intake side (left) to the exhaust side (right). The angle 21 of the truncated cone of the hub 4*a* is approximately 30 to 55 degrees, preferably 50 degrees, while the angle 22 of the truncated cone of the air housing 2 is approximately 15 to 30 degrees, preferably 20 degrees. These angles are coordinated in relation to one another so that the outlet cross section 15*b* is slightly narrower than the inlet cross section 15*a* of the flow channel 15.

As a result of this truncated cone shape of the hub 4*a* and of the air housing 2, the air flow is given a slight radial component, which has the effect of increasing pressure, compared to a purely axial fan. However, the angles 21, 22 of the truncated cones of the hub 4*a* and of the air housing 2 are deliberately kept small, to achieve an outlet direction similar to an axial fan on the outlet side.

Inside the hub 4*a* of the fan wheel 4 there is an electrical drive motor, which is designed as a motor with an external rotor. This drive motor contains a rotor 5, which is suitably fastened in a cylindrical section 18 of the fan wheel 5, preferably by locking. The rotor 5 is designed as a permanent magnet motor of a brushless direct current motor, which is opposite an internal stator 7. To fasten the motor, the mounting part 3 has a mounting flange 20, which is fastened to a ring-shaped section by means of a radial web 16, 16*a*. These webs 16 are relatively thin and are rounded, so that they do not interfere with the air flow on the outlet side. Molded on the mounting flange 20 is a bearing tube 8, which serves as a mounting for the shaft 9 of the rotor 5 by means of two ball bearings 10. The stator 7 is also fastened to the bearing tube 8, as well as a schematically indicated printed circuit board 6, which holds the electronic circuit elements to control the brushless direct-current motor. The hub 4*a* of the fan wheel also has recesses 24 to hold balancing weights.

The fan wheel 4, illustrated in detail in FIGS. 2 to 4, is one piece, preferably made of injection molded plastic, and in the present example has five fan blades 17 distributed over the circumference of the hub 4*a*. For manufacturing reasons, the fan blades 17 do not overlap in the circumferential direction. To minimize noise, the fan blades 17 are sickle-shaped, whereby the leading edges 17*a* are concave and the trailing edges 17*b* are convex, namely so that in the various circumferential planes, the fan blades 17 have approximately the same lengths in the flow direction. The fan blades 17 are also profiled, whereby the leading edge 17*a* has a radius of approximately 1% of the profile length in the flow direction, and the thickness of the profile is approximately 5% to 7% of the profile length. Otherwise, the fan blades 17 have a length in the radial direction so that—except for a tolerance gap, they extend to right up against the air housing 2.

To keep turbulence on the intake side as low as possible, the radii 11 and 12 of the hub 4*a* and of the air housing 2 are relatively large. The radius 11 is approximately 10 to 20 mm, preferably 15 mm, while the radius 12 of the air housing 2 is approximately 5 to 10 mm, preferably 6 mm. To reduce noise, the fan blades 17, which have the same geometry as one another, are not located at uniform intervals over the circumference of the hub 4*a* of the fan wheel 4, but are offset slightly from one another. Intervals between the fan blades of 72 degrees, 69 degrees, 75 degrees, 67.5 degrees and 76.5 degrees have been found to be successful when five fan blades are used.

As indicated above, the housing 1 consists of 2 parts, namely the air housing 2 and the mounting part 3. The air housing 2 is preferably a one-piece injection molded plastic part, while the mounting part 3 including the webs 16, the mounting flange 20 and the bearing tube 8 is fabricated as one piece from die-cast aluminum. The two parts are connected together by means of threaded connectors 13. These threaded connectors 13 are offset in relation to fastening holes 14 which extend through both parts. In addition to the webs 16 of the mounting part 3 there is an offset web 16*a*, through which connecting wires for the drive motor 5, 7 are routed. The offset of this web 16*a* has been selected to prevent a collision between the connecting wires and the fastening holes 14. Finally, the fan wheel, on the bottom inside the cylindrical segment 18, has reinforcement ribs 19, which are oriented radially.

The inclined path of the air housing 2 is continued in the mounting part 3, as indicated by a dashed line 3*a* in FIG. 1. The projecting parts, which in FIG. 1 apparently extend into the further path of the flow passage 15, extend to only a small degree in the circumferential direction, and correspond to the threaded connectors 13 or the bushings for the fastening holes 14 (See FIG. 5).

Modifications of the embodiment described above are of course possible, without departing from the theory of the invention. For example, it is possible to replace the brushless direct current motor, which in the present example has an external rotor, with an alternating current motor. Instead of a motor with an external rotor, a motor with an internal rotor can also be used. In the present example, however, which has the drive motor installed in the hub 4*a*, a motor with an external rotor is advantageous. The speed of the drive motor can be relatively low, on account of the features of the invention, which is an advantage from the noise point of view. The speed is in the range from 2000 to 3000 rpm, in particular 2400 to 2600 rpm, and is preferably 2500 rpm. Even at this low speed, on account of the configuration of the invention, it is possible to achieve a particularly high operating pressure with sufficient volumetric displacements.

Figure 6:
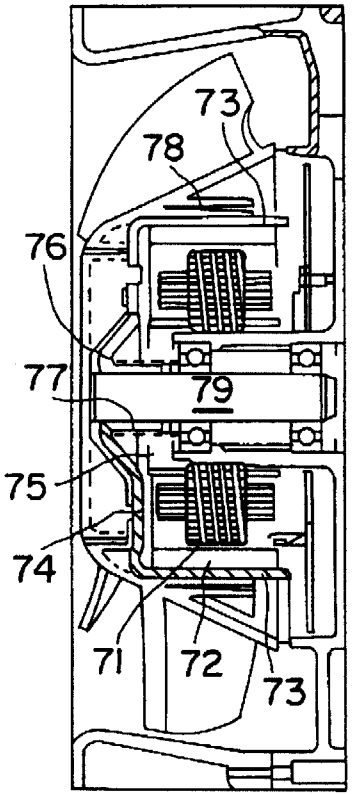
Figure 7:
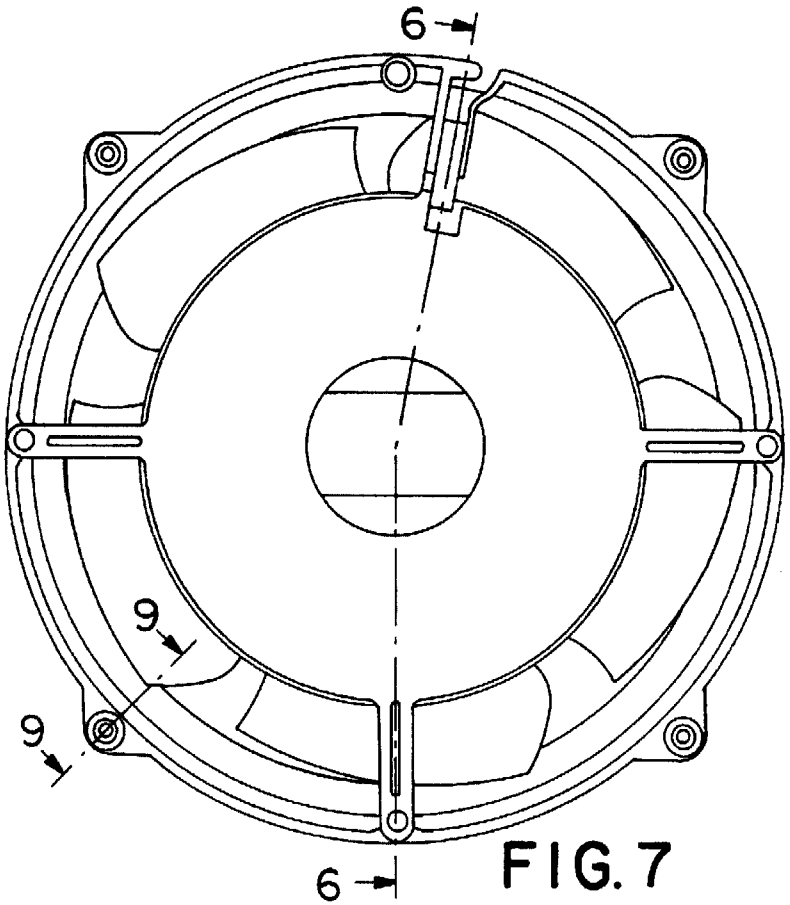
Figure 9:
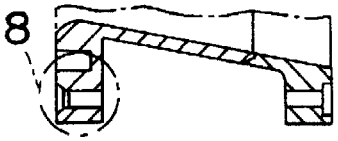
Figure 8:
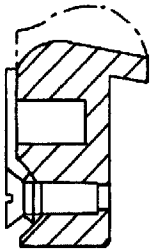

FIGS. 6, 7, 8 and 9 and 10 illustrate an additional embodiment of the invention, whereby FIG. 6: is an illustration similar to FIG. 1, and FIG. 7: is an illustration similar to FIG. 5, while FIG. 9: shows a detail of FIG. 7, and FIG. 8: shows a detail of FIG. 9, as is apparent from the drawing itself.

In this variant configuration, the external rotor ring 1/2, the one-piece parts 1, 2, 3 are not made of plastic, but of an injection molded metal part, e.g. from an aluminum alloy. In combination with the plastic rotor wheel, that makes it possible to achieve reliable tolerances, in particular in mass production, with regard to the smallest possible air gap between the radial outer edges of the rotor wheel and of the surrounding wall of the parts 1, 2, 3.

The essential difference between FIGS. 6 and 7 and FIGS. 1 and 5 is that while the rotor hub remains unchanged, i.e. with the same dimensions of the conical hub configuration of the rotor (whose blades are also unchanged), in this cone hub there is a brushless motor with an external rotor, whose cylindrical air gap can have a significantly greater diameter than in the case of FIG. 1.

This is achieved because the pot-shaped external rotor housing 73, 74 (See No. 5 in FIG. 1) encloses the hollow cylindrical permanent magnet ring 72 which, for its part, radially externally surrounds the air gap 71. This external-rotor motor is relatively large in diameter and axially shorter. Its electrically active length is approximately one-half the axial length of the total fan, i.e. the axial length of the internal stator between the end windings is approximately 0.4 to 0.6 times the axial length. The axial length of the permanent magnet ring 72 is approximately just as long. Not far from the left end surface of the permanent magnet ring 72, the bottom part 74 of the external rotor housing is drawn radially inward. In this base area, the plastic injection molded rotor hub is also fastened to the bottom part 74, and the radially-elastic inner edge 78 of the rotor hub (See 18 in FIG. 1) is in contact with a slight force fit on the cylindrical outside surface of 73. Radially farther inward, on the bottom 74, the rotor hub is again bent axially outward into a cone-like projection 75, which on the axial end 76 is bent into a cylindrical shape 77, in whose cylindrical inner surface the shaft 79 is precisely mounted with an interference fit (with a tight fit), because the entire external rotor housing of the elements 73, 74, 75, 76, 77 can be manufactured relatively precisely with a certain know-how. The axial indentation in the vicinity of the parts 75, 76, 77 is achieved at the expense of some axial length. Overall, however, it results in an economically advantageous fabrication, and the axially smaller rotor, which thus has a larger air gap diameter 71, is acceptable, without having to reduce the speed or power of the fan motor.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

I claim:

1. A diagonal fan comprising:

a housing;

said housing comprising:

an inlet end;

an outlet end;

an air channel;

said air channel being disposed between said inlet end of said housing and said outlet end of said housing;

said air channel having a truncated cone shape;

the truncated cone shape of said air channel having an angle;

the angle of said air channel being 15 degrees to 30 degrees;

said air channel having a center axis;

said air channel having a radius;

the radius of said air channel increasing from the inlet end of said housing to the outlet end of said housing; and an inner surface disposed towards the center axis, and said inner surface being configured to form the truncated cone shape of the air channel;

a fan wheel;

said fan wheel comprising:

an inlet end;

an outlet end;

a hub;

said hub having:

a truncated cone shape;

the truncated cone shape of said hub having an angle;

the angle of said hub being 30 degrees to 55 degrees;

a radius; and the radius of said hub increasing from said inlet end of said fan wheel to said outlet end of said fan wheel;

said fan wheel having an axis of rotation which axis of rotation is substantally coaxial with said center axis;

said hub comprising an outer surface disposed away from the axis of rotation, and said outer surface being configured to form the truncated cone shape of said hub;

a plurality of fan blades;

each of said fan blades comprising an inner edge and an outer edge;

said inner edges of said fan blades being mounted on said hub; and said outer edges of said fan blades extending toward and substantially disposed to said housing;

means for rotating said fan wheel about the axis of rotation;

a flow channel;

said flow channel being ring-shaped;

said flow channel being disposed between said hub and said housing;

said flow channel comprising:

an inlet side;

an outlet side;

said inlet side having a cross section;

said outlet side having a cross section;

the outlet cross section is narrower than the inlet cross section; and said flow channel having a direction of flow from said inlet cross section to said outlet cross section;

said fan blades being disposed in said flow channel;

said fan blades comprising a leading edge and a trailing edge;

said leading edges of said fan blades being disposed towards the inlet cross section of said flow channel;

said trailing edges of said fan blades being disposed towards the outlet cross section of said flow channel;

the inner surface of the truncated cone shape of said housing being disposed on a first conical plane;

the first conical plane having a central axis which axis being substantally coaxial with the axis of rotation of said fan wheel;

the outer surface of the truncated cone shape of said hub being disposed on a second conical plane;

the second conical plane having a central axis which axis being substantally coaxial with the axis of rotation of said fan wheel;

the first conical plane meets the second conical plane at an intersection;

each of said leading edges has a first point disposed thereon;

each of said trailing edges has a first point disposed thereon;

each of the first point of said leading edges and each of the first point of said trailing edges having a first path therebetween;

the first point of said leading edges and the first point of said trailing edges and the first path therebetween being disposed on a third conical plane extending from the intersection through the first point of said leading edges and through the first point of said trailing edges;

the third conical plane having a central axis which axis being substantally coaxial with the axis of rotation of said fan wheel;

each of said leading edges having a second point disposed theron different from the first point;

each of said trailing edges having a second point disposed thereon different from the first point;

each of the second point of said leading edges and each of the second point of said trailing edges having a second path therebetween;

the second point of said leading edge and the second point of said trailing edge and the second path therebetween being disposed on a fourth conical plane extending from the intersection through the second point of said leading edges and trough the second point of said trailing edges;

the fourth conical plane having a central axis which axis is substantially coaxial with the axis of rotation of said fan wheel; and the first path being substantial equal to the second path.

2. The diagonal fan according to claim 1, wherein:

said leading edges of said fan blades have a concave shape inwardly towards the fan blades;

said trailing edges of said fan blades have a convex shape outwardly away from the fan blades; and each of said fan blades has a sickled shape defined by the concavity of said leading edge of said fan blades and the convexity of said trailing edge of said fan blades.

3. The diagonal fan according to claim 2, wherein:

said flow channel has a circumferential direction extending circumferentially around the ring-shape of said flow channel;

said fan blades are disposed substantially in the circumferential direction;

said plurality of fan blades comprises five fan blades; and said five fan blades have axial spaces between one another in the circumferential direction.

4. The diagonal fan according to claim 3, wherein:

said fan blades have a shape;

each of said five fan blades have the same shape; and said five fan blades are disposed at unequal angular intervals over the circumferential direction.

5. The diagonal fan according to claim 4, wherein the angular intervals of said five fan blades are 72 degrees, 69 degrees, 75 degrees, 67.5 degrees and 76.5 degrees.

6. The diagonal fan according to claim 5, wherein:

each of said fan blades has a length extending from said leading edge to said trailing edge;

said leading edges of said fan blades having a profile;

said profile of said leading edges has a radius of one percent of the length of said fan blades;

said fan blades have a thickness; and the thickness of said fan blades is about 5 percent to 7 percent of the length of said fan blades.

7. The diagonal fan according to claim 6, wherein:

said hub comprises a rounded inlet edge;

said hub rounded inlet edge is adjacent to said inlet side of said flow channel;

said hub rounded inlet edge has a profile;

said hub profile has a radius of about 10 millimeters to 20 millimeters;

the hub profile radius is preferably 15 millimeters;

said housing comprises a rounded inlet edge;

said housing inlet edge is adjacent to said inlet side of said flow channel;

said housing rounded inlet edge has a profile;

said said housing profile has a radius of about 5 millimeters to 10 millimeters; and the housing profile radius is preferably 6 millimeters.

8. The Diagonal fan according to claim 7, wherein:

said rotating means comprises an electrical motor;

said hub comprises a cavity; and said electrical motor is disposed in said cavity of said hub.

9. The diagonal fan according to claim 8, wherein:

said rotating means comprises at least one bearing;

said rotating means comprises means for connecting said housing with said fan wheel;

said connection means comprises a mounting part; and said mounting part is disposed at said outlet side of said flow channel.

10. The diagonal fan according to claim 9, wherein:

said housing is made of injection molded plastic;

said mounting part is made of metal; and said metal comprises die cast aluminum.

11. The diagonal fan according to claim 10, wherein:

said mounting part comprises:

radial webs;

a mounting flange;

said radial webs are for mounting said mounting flange to said housing; and said at least one bearing of said rotation means is connected to said mounting flange.

12. The diagonal fan according to claim 11, wherein:

said mounting flange comprises a bearing tube;

said electrical motor comprises;

a rotor;

said rotor of said electrical motor is rotatably mounted on said bearing tube by means of said at least one bearing;

a stator;

said stator of said electrical motor is fixedly mounted on said bearing tube of said mounting flange.

13. The diagonal fan according to claim 12, wherein said electrical motor is a brushless direct current motor with a magnet external rotor.

14. The diagonal fan according to claim 13, wherein said electrical motor has a speed of about 2000 rpm to 3000 rpm, preferably 2500 rpm.

15. The diagonal fan according to claim 14, wherein:

the angle of said hub is 40 degrees;

the angle of said air channel is 20 degrees.

16. A diagonal fan comprising:

a housing;

said housing comprising:

an inlet end;

an outlet end;

an air channel;

said air channel being disposed between said inlet end of said housing and said outlet end of said housing;

said air channel having a truncated cone shape;

the truncated cone shape of said air channel having an angle;

said air channel having a center axis;

said air channel having a radius; and the radius of said air channel increasing from the inlet end of said air channel to the outlet end of said air channel;

an innersurface disposed towards the center axis, and said inner surface being configuredto form the truncated cone shape of the air channel;

a fan wheel;

said fan wheel comprising:

an inlet end;

an outlet end;

a hub;

said hub having:

a truncated cone shape;

the truncated cone shape of said hub having an angle; a radius; and the radius of said hub increasing from said inlet end of said fan wheel to said outlet end of said fan wheel;

said fan wheel having an axis of rotation which axis of rotation is substantally coaxial with said center axis;

said hub comprising an outer surface disposed away from the axis of rotation, and said outer surface being configured to form the truncated cone shape of said hub;

a plurality of fan blades;

each of said fan blades comprising an inner edge and an outer edge;

said inner edges of said fan blades being mounted on said hub; and said outer edges of said fan blades extending toward and substantially disposed to said housing;

means for rotating said fan wheel about the axis of rotation;

a flow channel;

said flow channel being ring-shaped;

said flow channel being disposed between said hub and said housing;

said flow channel comprising:

an inlet side;

an outlet side;

said inlet side having a cross section;

said outlet side having a cross section; and said flow channel having a direction of flow from said inlet cross section to said outlet cross section;

said fan blades being disposed in said flow channel;

said fan blades comprising a leading edge and a trailing edge;

said leading edges of said fan blades being disposed towards said inlet side;

said trailing edges of said fan blades being disposed towards said outlet side;

the inner surface of the truncated cone shape of said housing being disposed on a first conical plane;

the first conical plane having an axis which axis is substantally coaxial with the axis of rotation of said fan wheel;

the outer surface of the truncated cone shape of said hub being disposed on a second conical plane;

the second conical plane having a central axis which axis is substantially coaxial with the axis of rotation of said fan wheel;

said inner surface of the truncated cone shape of said housing being disposed with respect to said outer surface of the truncated cone shape of said hub such that the first conical plane meets the second conical plane at an intersection;

the intersection being disposed closer to said outlet side then said inlet side;

each of said leading edges has a first point disposed thereon;

each of said trailing edges has a first point disposed thereon;

each of the first point of said leading edges and each of the first point of said trailing edges having a first path therebetween;

the first point of said leading edges and the first point of said trailing edges and the first path therebetween being disposed on a third conical plane extending from the intersection through the first point of said leading edges and through the first point of said trailing edges;

the third conical plane having a central axis which axis is substantally coaxial with the axis of rotation of said fan wheel;

each of said leading edges having a second point different from the first point;

each of said trailing edges having a second point different from the first point;

each of said leading edges second point and each of said trailing edges second point having a second path therebetween;

the second point of said leading edges and the second point of said trailing edges and the second path therebetween being disposed on a fourth conical plane extending from the intersection through the second point of said leading edges and trough the second point of said trailing edges;

the fourth conical plane having a central axis which axis is substantally coaxial with the axis of rotation of said fan wheel; and the first path being substantial equal to the second path.

17. The diagonal fan according to claim 16, wherein:

each of said first point of said leading edges are disposed a substantial distance from said hub;

each of said first point of said leading edges are disposed a substantial distance from said outer edges of said fan blades;

each of said first point of said trailing edges are disposed a substantial distance from said hub;

each of said first point of said trailing edges are disposed a substantial distance from said outer edges of said fan blades;

each of said second point of said leading edges are disposed a substantial distance from said hub;

each of said second point of said leading edges are disposed a substantial distance from said outer edges of said fan blades;

each of said second point of said trailing edges are disposed a substantial distance from said hub;

each of said second point of said trailing edges are disposed a substantial distance from said outer edges of said fan blades.

* * * * *

UNITED STATES PATENT AND TRADEMARK OFFICE

CERTIFICATE OF CORRECTION

PATENT NO. : 5,695,318

DATED : December 9, 1997

INVENTOR(S) : Siegfried HARMSEN

It is certified that error appears in the above-identified patent and that said Letters Patent is hereby corrected as shown below:

On the title page, item [56], under the FOREIGN PATENT DOCUMENTS section, after "0810834', delete "3/1957" and insert --3/1959--.

In column 4, line 31, after '9' delete "and 10".

In column 10, line 33, Claim 16, after 'and', delete "trough" and insert --through--.

In column 7, line 16, Claim 1, after 'and', delete "trough" and insert --through--.

In column 10, line 5, Claim 16, before 'said', delete "then" and insert --than--.

In column 10, line 39, Claim 16, after 'being', delete "substantial" and insert --substantially--.

Signed and Sealed this

Sixteenth Day of March, 1999

*Attest:*

*Attesting Officer*

Q. TODD DICKINSON

*Acting Commissioner of Patents and Trademarks*